United States Patent [19]

Perkins

[11] 4,200,158

[45] Apr. 29, 1980

[54] FLUID RETARDED ACCELERATING JAR WITH NEGATIVE AND POSITIVE PRESSURE CHAMBERS

[75] Inventor: Lee E. Perkins, P.O. Box 6034, Houma, La. 70360

[73] Assignee: Lee E. Perkins, Houma, La.

[21] Appl. No.: 883,316

[22] Filed: Mar. 3, 1978

[51] Int. Cl.[2] ..... E21B 1/10

[52] U.S. Cl. ..... 175/297; 175/296; 166/178

[58] Field of Search ..... 175/296, 297; 166/178

[56] References Cited

U.S. PATENT DOCUMENTS

| | | | |
|---|---|---|---|
| 3,642,069 | 2/1972 | Adkins | 175/296 X |
| 3,815,693 | 6/1974 | Sutliff et al. | 175/296 X |
| 3,834,472 | 9/1974 | Perkins | 175/296 X |
| 3,853,187 | 12/1974 | Sutliff et al. | 175/297 |
| 4,076,086 | 2/1978 | Evans | 175/297 |

*Primary Examiner*—Ernest R. Purser
*Assistant Examiner*—Nick A. Nicholas, Jr.
*Attorney, Agent, or Firm*—Fleit & Jacobson

[57] ABSTRACT

A hydraulic drilling jar apparatus having axially elongated outer housing and inner mandrel members that telescope relative to each other when tripped by a predetermined axial force applied to the mandrel to deliver an impact blow to an object stuck in a well bore. A negative pressure is developed within the apparatus during initial retarded telescoping movement to effect acceleration of the mandrel member upon release at a rate exceeding the acceleration rate otherwise imposed by the axial force.

21 Claims, 14 Drawing Figures

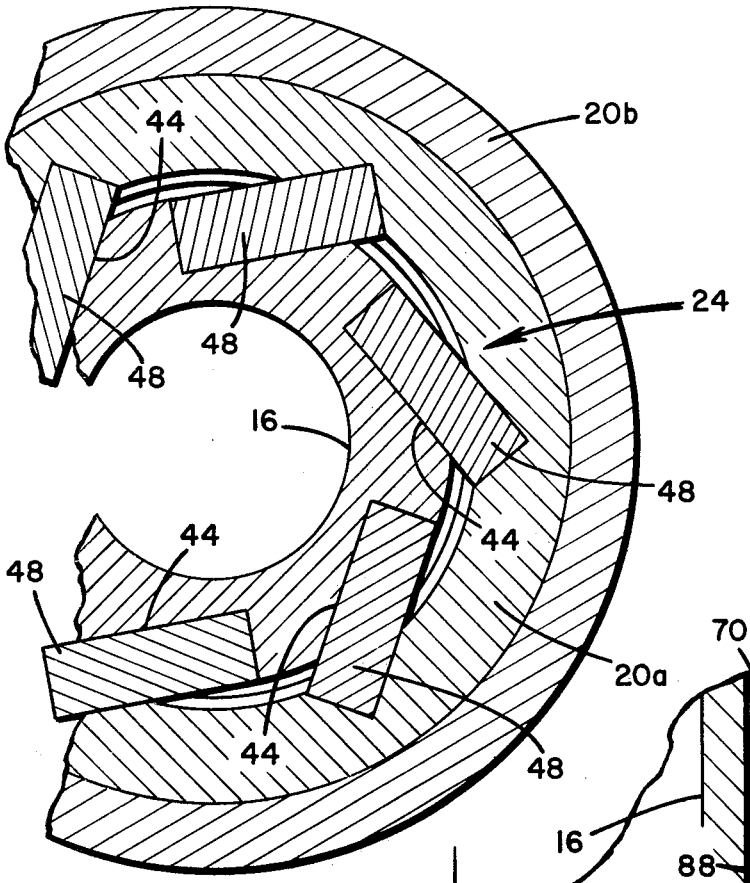
FIG. 4
FIG. 5
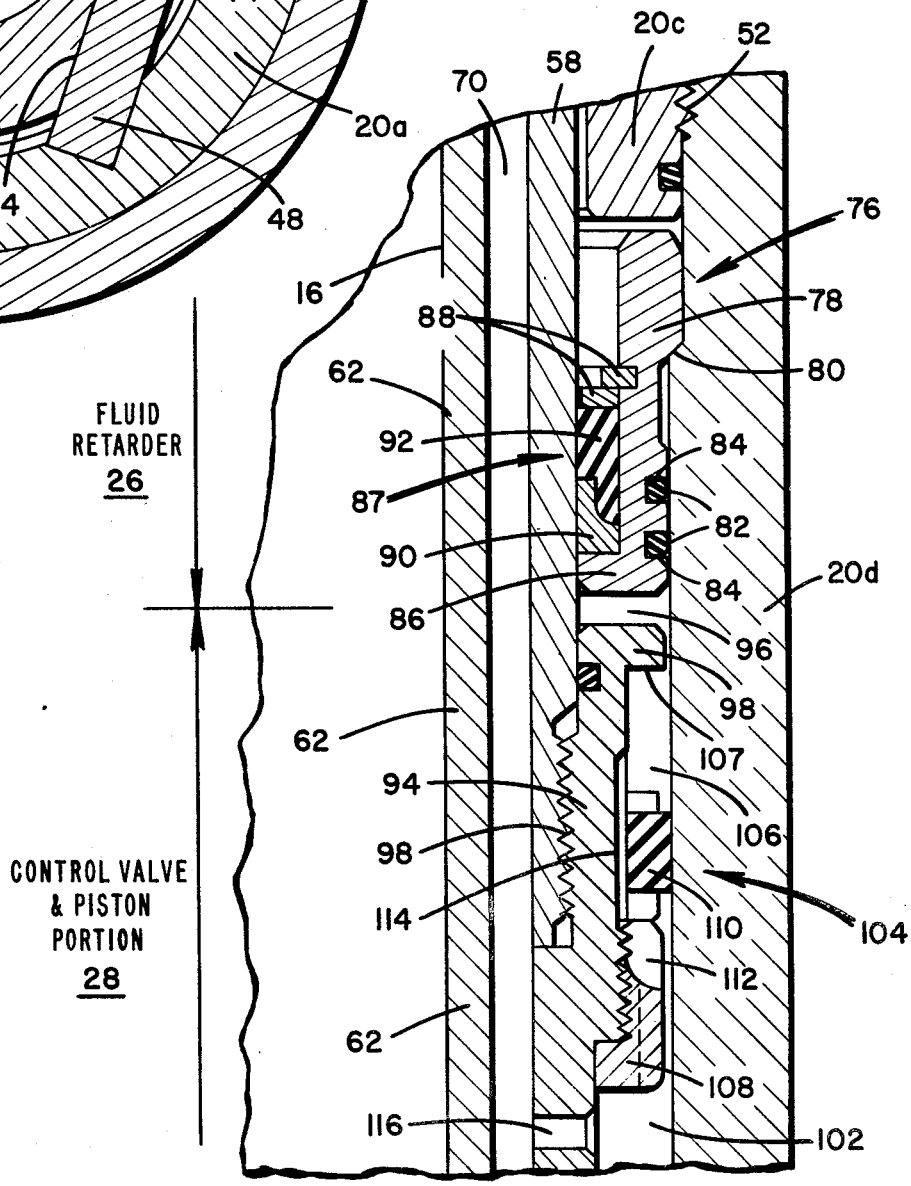

FLUID RETARDED ACCELERATING JAR WITH NEGATIVE AND POSITIVE PRESSURE CHAMBERS

BACKGROUND OF THE INVENTION

This invention relates to hydraulic jarring devices in general and more particularly to a jarring device through which impact is applied to a stuck well bore object by travel of a mandrel at an accelerated rate to an impact position.

Hydraulically controlled jarring devices for dislodging stuck objects or fish from a drilling well bore are well-known, such as the jarring devices described in my prior U.S. Pat. No. 3,729,058, and in my presently copending applications, Ser. Nos. 605,057 and 754,885.

Generally, the jarring device includes a mandrel telescopically mounted within an outer housing to form a tool adapted to be connected in a drill string through which the tool transmits an impact force to a stuck object within the well bore when an axial compression force is applied to the drill string. A fluid pressure operated valving system, located between the housing and mandrel, acts to resist any relative longitudinal movement induced by the axial compressive force. Upon release by the valving system of the fluid pressure, the mandrel is caused to move, relative to the housing, to an impact position at which a hammer surface applies a blow to an anvil surface, thereby transferring the applied force in an attempt to free the stuck object. The jarring cycle is repeated by controlling the application of the axial force at the well bore surface. It is often desirable to be able to select or vary the magnitude of the axial force, applied at the well surface, necessary to trip or complete a jarring cycle, so as to accommodate different well bore conditions. For example, in order to provide a jarring blow of adequate force, it is quite common to increase the impact mass by running a number of heavy drill collars into the well above the jarring tool. It is then desirable to select a minimum tripping force to initiate a jarring cycle and yet avoid unintentional tripping of the jarring device by the weight of the drill collars themselves. Unintentional tripping of the jarring apparatus could damage the drill bit during the drilling operation.

Very often jarring devices with limited operative capability must be used in order to apply an impact blow with increased force in order to extricate stuck objects. It is therefore desirable to provide a tool by means of which the force imparted to the mandrel may be tailored to meet certain well bore conditions.

Because of the foregoing, an important object of the present invention is to provide a jarring tool capable of applying an impact blow when tripped by a force of preselected value, the impact blow being of greater magnitude than that ordinarily produced by the initial tripping force.

It is another object of the present invention to provide a jarring tool for delivering an accelerated impact blow by internally generating a negative pressure which produces the desired acceleration.

It is yet another object of the present invention to provide a jarring tool for delivering an accelerated impact blow in the downward direction.

It is a still further object of the present invention to provide a jarring tool for delivering an accelerated impact blow in the upward direction.

The manner in which these and other objects are accomplished by the present invention will become clear from the following detailed description.

SUMMARY OF THE INVENTION

In accordance with the present invention, at the beginning of a jarring cycle, an axially elongated mandrel will undergo retarded travel for a predetermined distance before release, after which the mandrel is accelerated until its hammer surface strikes the anvil surface of the housing in order to deliver the impact blow. Initial retarded movement is controlled by a fluid pressure system mounted between the mandrel and the housing. The fluid pressure system includes a shiftable seal that is engaged in response to initial movement of the mandrel to cause generation of a suction pressure within an expanding void chamber, at the same time that operating fluid is being pressurized within a contracting chamber. The pressurized fluid maintains the seal in operative position during development of the suction pressure and also opposes the axial force applied at the well-bore surface to initiate the jarring cycle. This initial axial force, plus the weight applied above the jarring tool, must be sufficient to maintain travel of the mandrel until the sea is bypassed in order to equalize the fluid pressures within the expanding and contracting chambers discussed above. In order to permit initial retarded movement and development of a net negative pressure internal to the jarring tool, restricted outflow of fluid from the contracting chamber is conducted at a rate controlled by a flow meter device.

When the shiftable seal device is bypassed after a predetermined initial travel of the mandrel, the pressures within the expanding void chamber and contracting chamber are equalized to release the mandrel and to accelerate its rate of travel to the impact position. The entire fluid system is then under a negative pressure diminished at a restricted rate by inflow of fluid through a flow restrictor device from the well bore. The latter restricted inflow rate is adjusted so as to maintain a negative pressure in the system until impact has occurred, the negative internal pressure of the system causing a pressure differential to be externally applied to the jarring tool in order to augment the initial tripping force and thereby increase the rate at which the mandrel is accelerated following its initial release. After impact, the mandrel is returned to its initial position causing the shiftable seal to be withdrawn from its sealing position and decreasing the size of the void chamber in preparation for a new jarring cycle.

Operating fluid is supplied to a control chamber and the variable volume chambers aforementioned from a constant volume reservoir chamber formed in the mandrel. Well-bore fluid enters a sensing chamber isolated from the operating fluid chambers by a balancing piston through which well-bore pressure is maintained in the control chamber until accelerated travel begins. The flow restrictor then regulates inflow of well-bore fluid to the sensing chamber.

In one embodiment hereinafter described, accelerated travel of the mandrel to the impact position is effected in a downward direction whereas upward travel to an impact position is effected in accordance with another embodiment. In order to tailor the rate of acceleration to different well bore conditions and requirements, one or more expanding void chambers and associated shiftable seal devices may be provided in the jarring apparatus. Also, a pressure reducing type of balancing piston may be utilized in another embodiment of the invention to isolate well-bore fluids from the operating fluid within the jarring tool.

BRIEF DESCRIPTION OF THE DRAWINGS

FIG. 4 is a transverse sectional view taken substantially through a plane indicated by section line 4—4 in FIG. 3.

FIG. 5 is an enlarged partial sectional view taken substantially through a plane indicated by section line 5—5 in FIG. 1.

DETAILED DESCRIPTION OF THE PREFERRED EMBODIMENTS

Figure 1:
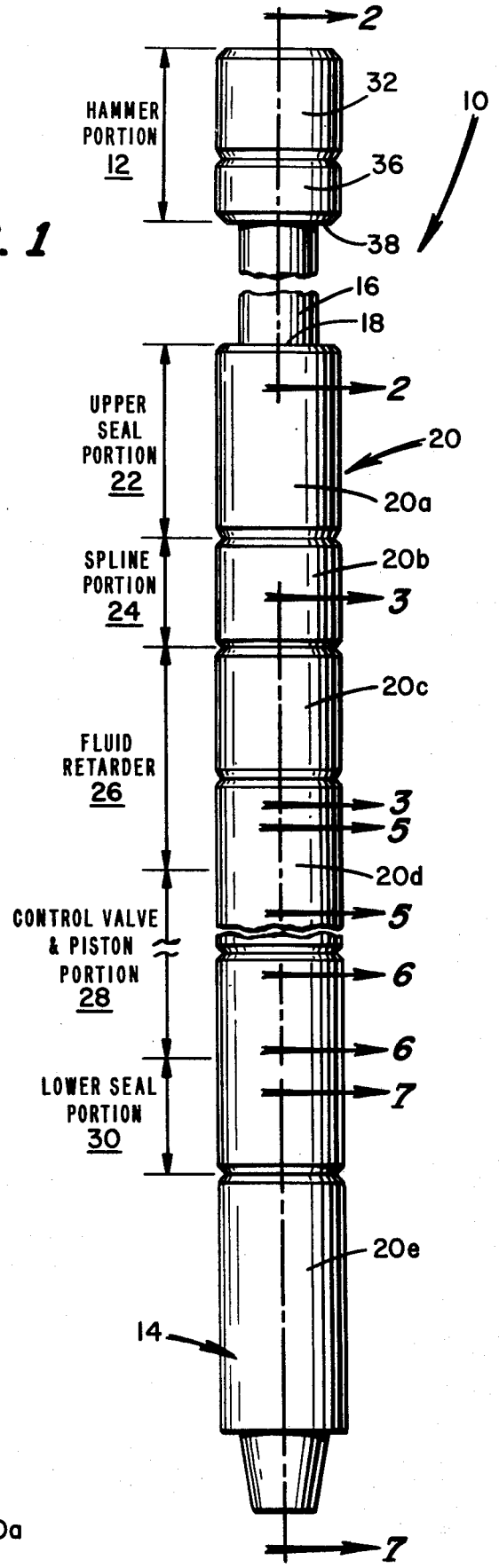
FIG. 1 is a partial side elevation view of a jarring tool constructed in accordance with the present invention.

Referring now to the drawings, FIG. 1 illustrates one embodiment of a jarring tool constructed in accordance with the present invention and generally referred to by reference numeral 10. The tool 10 is adapted to be installed within a well-bore drill string so as to transmit an impact blow to a stuck object at the lower end of the drill string in response to an axial compressive force applied to the drill string above the well-bore surface, in a manner well known to those skilled in the art. The axial compressive force is transmitted to an upper end of the jarring tool 10 through its hammer portion 12. The magnitude of the axial compressive force must be above a minimum value in accordance with the present invention in order to initiate a jarring cycle resulting in the delivery of an impact below through the lower end portion 14 of the jarring tool 10. The impact force is produced when the hammer section 12, associated with a radially inner tubular mandrel member 16, impacts against an anvil surface 18 at the upper end of a radially outer housing or case generally referred to by reference numeral 20. The mandrel member 16 accordingly extends telescopically through the outer housing 20. The housing 20 is made up of a plurality of rigidly interconnected, axial housing portions including an upper portion 20*a* enclosing an upper seal portion 22 of the tool and on which the upper anvil surface 18 is formed. A section 20*b* of the housing enclosed a spline portion 24 of the tool and is located below the upper portion 20*a*. Another housing portion 20*c*, below section 20*b* encloses a fluid retarding portion 26 of the jarring tool. A control valve and piston portion 28 of the jarring tool is enclosed by another housing portion 20*d* connected to housing portion 20*c*, the housing portion 20*d* also enclosing a lower seal portion 30 of the jarring tool. The lowermost housing portion 20*e* is associated with the lower end portion 14 of the jarring tool which is in intimate contact with the object stuck in the well bore.

Figure 2:
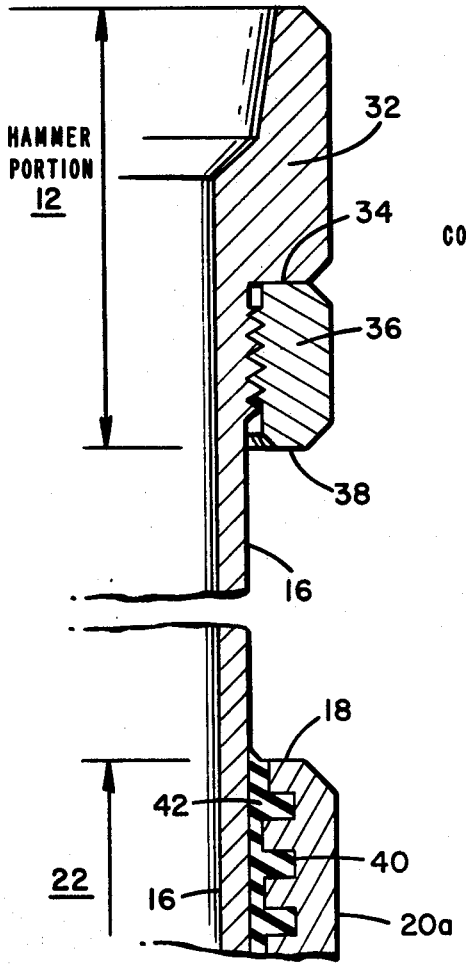
FIG. 2 is an enlarged partial sectional view taken substantially through a plane indicated by section line 2—2 in FIG. 1.

As more clearly seen in FIG. 2, the hammer portion 12 of the jarring tool includes a radially enlarged coupling portion 32 of the mandrel 16 and forms a shoulder 34, which is in abutment with an annular hammer collar 36 threaded onto the mandrel 16. This collar 36 presents an annular hammer surface 38 in confronting relationship to the annular anvil surface 18 at the upper end of the housing portion 20*a*. In the open position of the mandrel 16 and housing 20*a*, as shown in FIGS. 1 and 2, the hammer and anvil surfaces 38 and 18 respectively will be axially spaced apart by a distance through which the mandrel must travel in a downstroke to the impact position within the well bore. The upper seal portion 22 is located at the upper end of housing portion 20*a* and includes internal grooves 40 within which annular seals 42 are carried in wiping contact with the outer cylindrical surface of the mandrel 16, in order to seal cavities formed between the inner mandrel 16 and the housing 20 located axially below the seals 42. Because of the seals 42, the jarring tool will be exposed to a static well bore pressure applied to the annular anvil surface 18 and the annular hammer surface 38 prior to impact.

Figure 3:
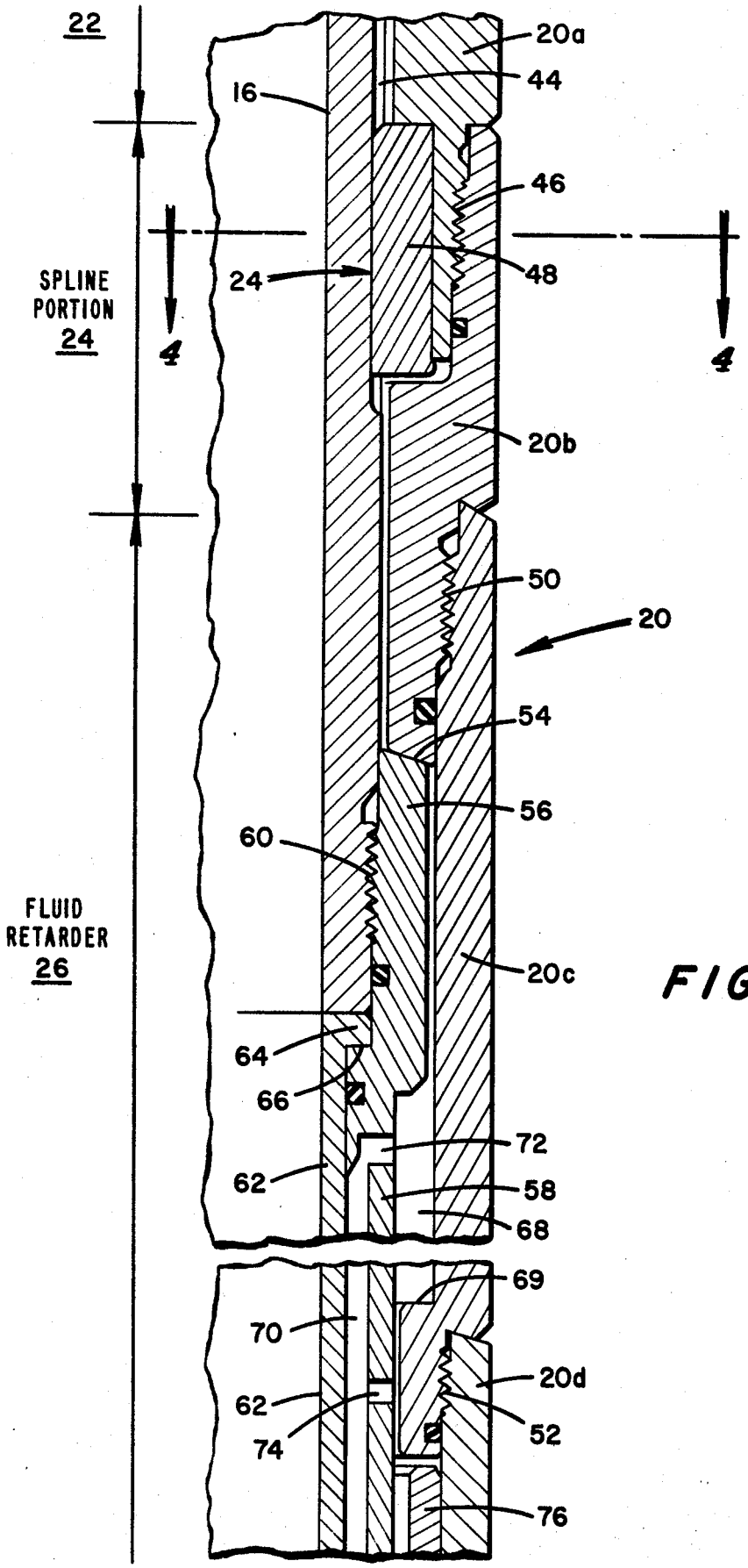
FIG. 3 is an enlarged partial sectional view taken substantially through a plane indicated by section line 3—3 in FIG. 1.

Referring to FIG. 3, the mandrel 16 is provided on its radially outer surface with a plurality of circumferentially spaced, axially extending, spline grooves 44 to form the spline portion 24 of the tool. The spline grooves 44 extend axially into the housing portion 20*b*, which is threadably connected at 46 to the housing portion 20*a* as shown in FIG. 3. The spline grooves 44 slidingly receive key elements 48 through which torque is transmitted between the mandrel and housing, while permitting axial telescopic movement relative to each other along the common longitudinal axis of the mandrel and housing. Housing section 20*b*, 20*c* and 20*d* are threadably connected at 50 and 52 respectively to form a flush external cylindrical surface. In the open position shown in FIG. 3, which corresponds to the position of the inventive device shown in FIGS. 1 and 2, an annular bevelled end surface 54 of the housing portion 20*b*, located below the threaded connection 50 within housing portion 20*c*, abuts an upper end portion 56 of a cylindrical hammer mandrel 58, to which mandrel 16 is threadably connected at 60. A cylindrical inside mandrel 62 having an upper flanged end 64 is held in abutment with the lower end of the mandrel member 16 by the flange 64, which associates with the hammer mandrel 58 such that the mandrels are caused to move as a unit. The flange 64 is clamped against the lower end of the mandrel 16 by a shoulder 66 formed in the hammer mandrel 58. A variable volume, pressure generating chamber 68 is formed between the hammer mandrel 58 and the housing section 20*c*, located below the upper end portion 56 of the hammer mandrel 58. It will be appreciated that the cylindrical chamber 68, which extends axially between the hammer mandrel upper portion 56 and a shoulder portion 69 formed at the lower end of housing section 20*c*, will be contracted in response to downward travel of the mandrel member 16 relative to the housing. This contraction of chamber 68 serves to pressurize the operating fluid entrapped within the chamber 68, which is in fluid communication with other passages formed thereabove between the mandrel and the housing below the seals 42. The fluid chamber 68 is in fluid communication with still other fluid chambers formed between the mandrel and housing therebelow by means of a fluid chamber 70, formed within the hammer mandrel 58. The chamber 70 communicates with chamber 68 through an upper port 72. Also formed in the hammer mandrel 58 is a lower by-pass port 74, which permits fluid communication between chambers 68 and 70. The function of this lower by-pass port 74 is to effect release of the fluid retarder portion 26, which will be explained in more detail hereinafter.

As seen in FIG. 5, the fluid pressure generating chamber 68 is effectively sealed at its lower end by means of an annular sealing assembly 76, including a tubular carrier element 78 which acts as a seal retainer. This carrier element 78 has a radial enlargement abutting a bevelled shoulder 80 on the housing portion 20*d*, below which the inside of housing portion 20*d* is in wiping contact with a pair of O-ring seals 82 seated within annular grooves 84 formed in the carrier member 78. The carrier member 78 forms an annular cavity about the hammer mandrel 58, closed by a lower end portion 86 of the carrier member against which a seal assembly 87 is held in contact by snap rings 88. The seal assembly 87 includes a rigid metal sleeve 90 to which an elastomeric seal element 92 is bonded, and arranged in wiping contact with the outer surface of the cylinder 58. Threadably attached to the lower end of the hammer mandrel 58 is a mandrel element 94. The location of the seal assembly 87 serves to effectively isolate the chamber 68 from an expansible void chamber 96 formed below the seal assembly 76 by the hammer mandrel 58, the housing portion 20*d*, and an upper portion 98 of the mandrel element 94.

The inner cylindrical surface of mandrel element 94 together with the inside mandrel 62 maintains the formation of chamber 70 further down the length of the tool. The mandrel element 94 forms a constant volume reservoir chamber 102 below a slidable seal assembly 104. The seal assembly 104 is slidably retained within an annular cavity 106, formed between shoulder 107 at the top, and an annular threaded retaining ring 108 at the bottom, which is threadably attached to mandrel element 94. The seal assembly 104 includes an annular elastomeric element 110 that is in wiping contact with the inner cylindrical surface of housing portion 20*d* and in sliding contact with the outer surface of mandrel element 94 between shoulder 107 and the upper surface of retaining ring 108. Retaining ring 108 is provided with fluid passage slots 112 which extend therethrough. By-pass passage grooves 114 are formed on the outer cylindrical surface of mandrel element 94, terminating in spaced relation to the shoulder 107 of element 94, so that in the relatively lower position of the seal assembly 104, as shown in FIG. 5, fluid may pass along the grooves 114 behind the seal 104 and through the slots 112 in the ring 108. In this manner, reservoir chamber 102 will not always be sealed from the expansible void chamber 96 thereabove. Upon telescopic movement of mandrel element 94, the seal element 110 will abut the outer cylindrical surface of mandrel element 94 and the inner surface of housing 20*d* and the seal assembly 104 will thereby effectively seal off and isolate the chambers 96 and 102 from each other. The seal assembly 104 is displaced to its upper operative sealing position relative to the mandrel element 94 when the mandrel is downwardly displaced at the beginning of a jarring cycle, so that continued downward travel will effectively produce a partial vacuum or suction pressure within the expandable void chamber 96, as it is being volumetrically expanded. The fluid pressure generated within chamber 68 during such initial downward movement of the mandrel members is transferred to chamber 102, whereby the seal assembly 104 is held in its upper operative position maintaining the expanding void chamber 96 sealed. Pressure is transferred to chamber 102 through annular chamber 70 which communicates with chamber 102 at its uppermost end through port 116 and at its lowermost end through port 117, see FIG. 6.

Figure 6:
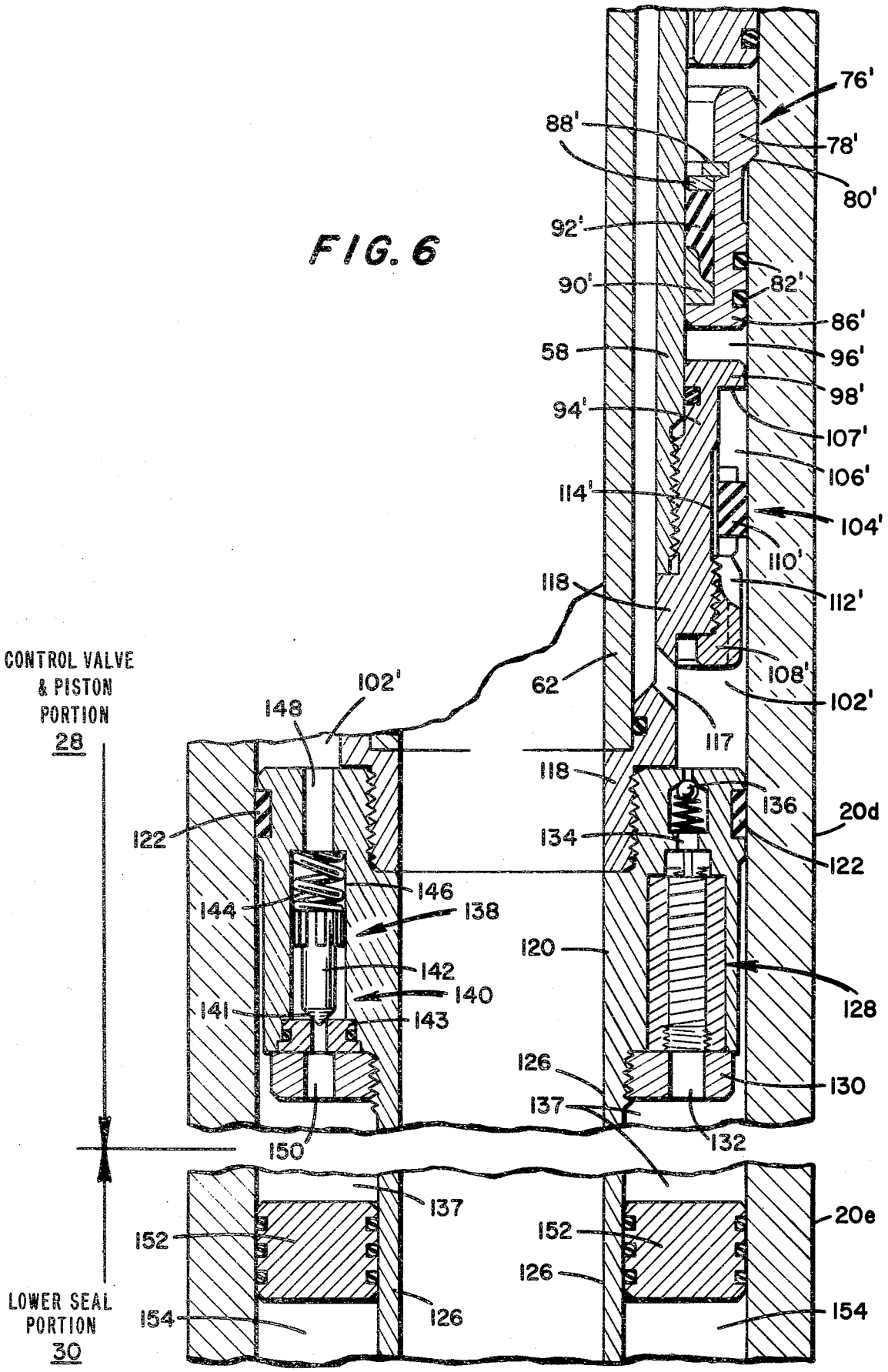
FIG. 6 is an enlarged partial sectional view taken substantially through a plane indicated by section line 6—6 in FIG. 1.

The embodiment being described in detail is of the type which requires at least two expansible void chambers, such as chamber 96 described in relation to FIG. 5. Since the structure used to provide these chambers is substantially identical, the second expansible void chamber, which is shown in FIG. 6, need not be described in detail. Additionally, since the elements forming this second chamber are identical to those which formed the first chamber, the same reference numerals have been assigned as their corresponding parts in FIG. 5, except that the "prime" notation has been added.

With reference to FIG. 6, the inside mandrel 62, abuts at its lower end an adaptor element 118 to which a valve body 120 is threadably connected. An annular seal element 122 is seated within an annular groove formed in the outer cylindrical surface of the valve body, so as to seal the reservoir chamber 102 by wiping contact with the inner surface of the housing portion 20*d*. A tubular extension 126 of the valve body 120 forms the lower end of the mandrel, projecting into the lower housing portion 20*e*.

Mounted within the tubular valve body 120 is a flow metering valve, generally referred to by reference numeral 128, the flow metering valve being held assembled within the valve body by an annular assembly collar 130, threadably connected to the mandrel extension 126, and having an outlet port 132 formed therein. The flow metering valve device 128 is of a type disclosed in my above-identified co-pending application, U.S Ser. No. 605,057. The flow metering valve 128 conducts a restricted flow of fluid from the chamber 102 through an inlet passage 134 in the valve body 120 to a fluid control chamber 137 into which the outlet passage 132 opens. Unrestricted flow of fluid in the opposite direction from chamber 137 to chamber 102 is blocked by a one-way check valve 136 located in the inlet passage 134 of the flow metering device 128, as shown in FIG. 6. However, when the pressure within chamber 102 drops below pressure in chamber 137, as will be hereinafter explained, fluid communication is established between the chambers 137 and 102 through a one-way check valve assembly 138, also mounted within the valve body 120 but in 180° relationship to the flow metering valve device 128.

As shown in FIG. 6, the one-way check valve assembly 138 includes a valve element 140 which is formed having a tapered tip portion 141 and a shank portion 142. The valve 140 is biased to a closed position on a valve seat 143 by a spring 144 enclosed within a valve cavity 146. An inlet passage 148 establishes fluid communication between chamber 102 and the valve cavity 146, while fluid communication is provided by outlet passage 150 in the assembly collar 130 between the valve seat 142 and chamber 137.

The various cavities, chambers, and passages formed between the mandrel and the housing portions within the jarring tool 10 are filled with an operating fluid such as oil, so that the appropriate pressures may be developed. Static well bore pressure is substantially maintained within chamber 137 by displacement of a balancing piston 152 disposed within the housing portion **20*d* about the mandrel extension 126, as shown in FIG. 6. The lower annular surface of the balancing piston 152 is exposed to well-bore fluid in a sensing chamber 154, which is isolated by the balancing piston 152 from chamber 137**.

Figure 7:
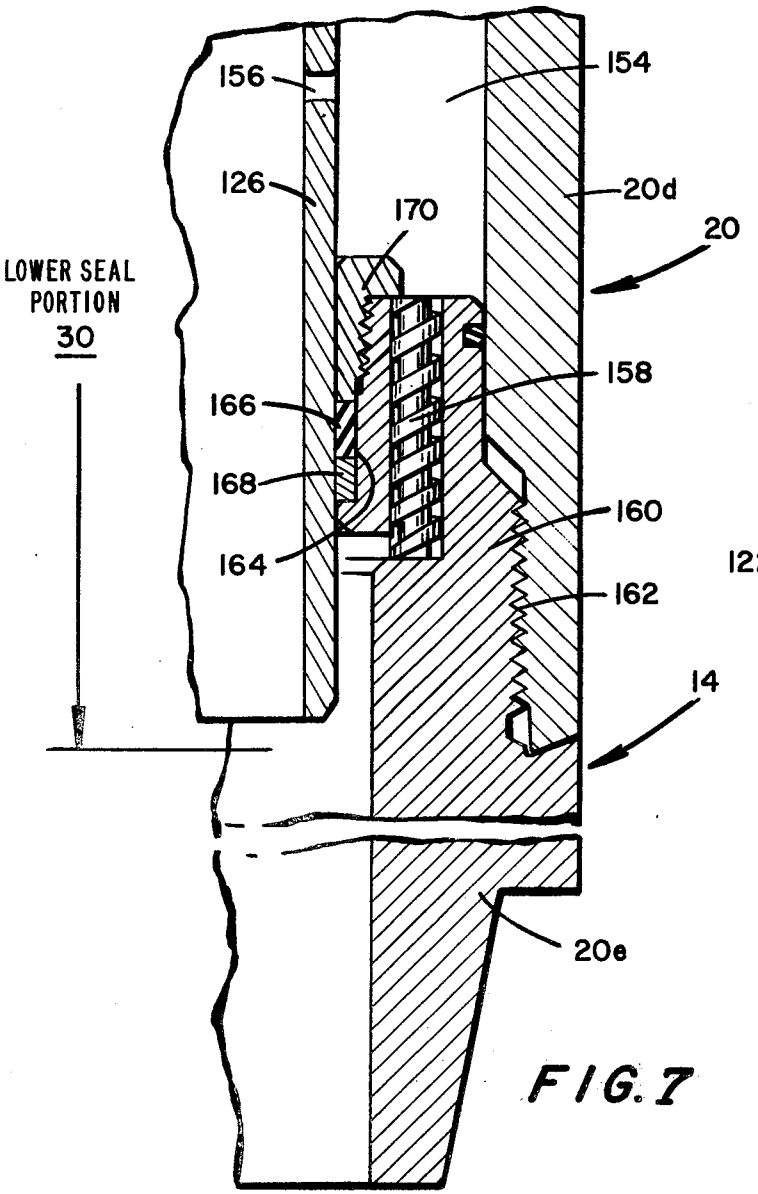
FIG. 7 is an enlarged partial section view taken substantially through a plane indicated by section line 7—7 in FIG. 1.

Referring to FIG. 7, unrestricted fluid communication is established between lower chamber 154 and the well bore, through a port 156 in the mandrel extension 126. The lower axial end of the chamber 154 is otherwise isolated from the well bore by the lower seal portion 30 of the tool carried by the housing portion **20*e*. A spiral flow restrictor 158 is mounted within a shouldered connector portion 160 of the housing 20*e*, to which the housing portion 20*d* is threadedly connected at 162. The connector section 160 is provided with a recess 164 seating an elastomeric seal element 166, in wiping contact with the mandrel extension 126. The seal element 166 is held assembled between a rigid annular wear ring 168 and a threaded retainer element 170. The lower seal portion 30, FIG. 1, is therefore operative to seal the chamber 154 from the well bore when the port 156 in the mandrel extension 126 is carried past the seal element 166 after a predetermined amount of downward travel of the mandrel relative to the housing 20. Restricted fluid communication is then established between the well bore and the sensing chamber 154 through the spiral flow restrictor 158**.

Figure 9:
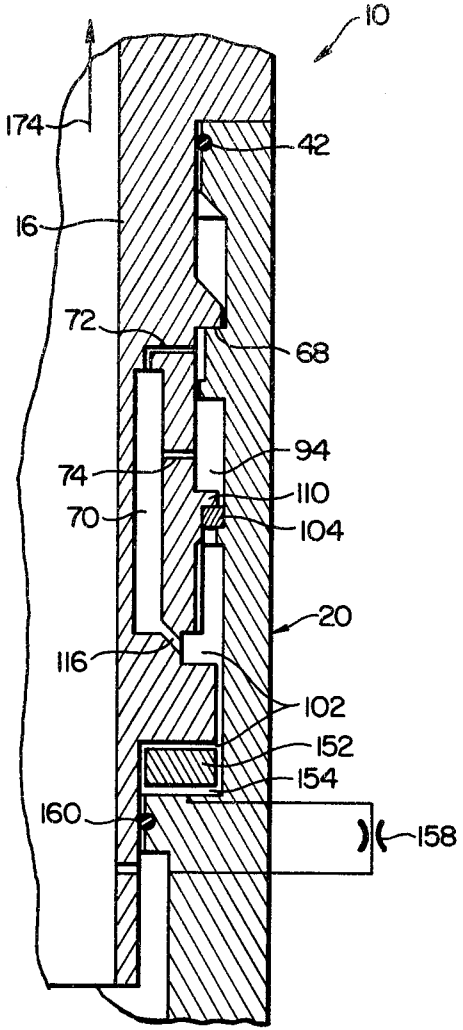
FIG. 9 is a schematically simplified partial sectional view of the jarring tool in its closed impact position.
Figure 8:
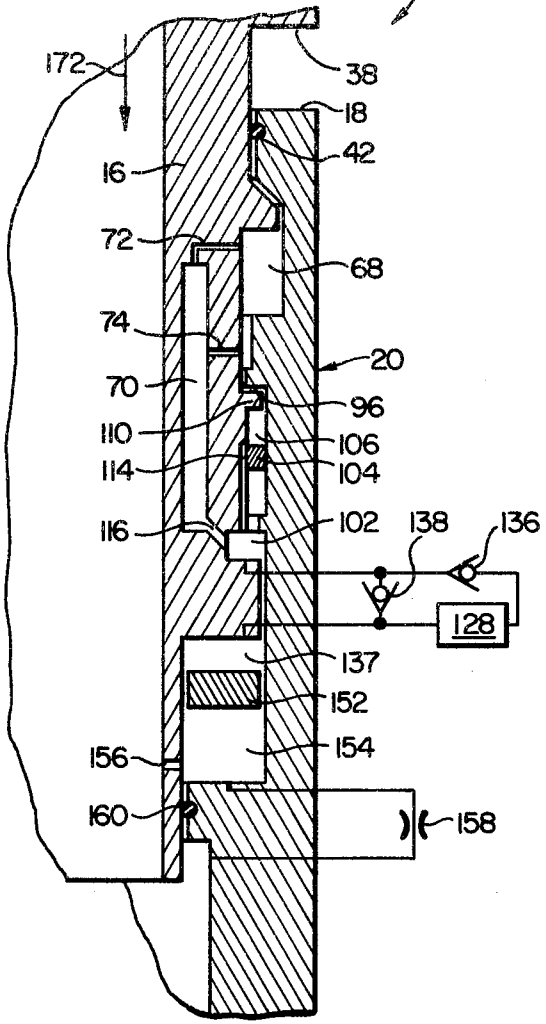
FIG. 8 is a schematically simplified partial sectional view showing the jarring tool in an open condition at the beginning of a jarring cycle.

Referring now to the simplified schematic illustrations in FIGS. 8 and 9, the structure and operation of the jarring tool 10 may be summarized. FIG. 9 shows the jarring tool in its open condition at the beginning of a jarring cycle wherein downward travel of the mandrel 16 begins as indicated by arrow 172. The housing 20 is held substantially stationary within the well bore by the stuck object to which it is anchored by the drill string. The variable volume chambers 68, 96, and 137, as well as the constant volume reservoir chamber 102 formed between the mandrel and the housing are charged with the operating fluid and isolated from the well bore by the upper seal 42 and the lower seal portion 30, except for the sensing chamber 154 which is in fluid communication with the well bore through port 156 formed within the mandrel adjacent its lower end, as shown in FIG. 6. In the open position, of FIG. 8, fluid communication is established between the chambers 68 and 102 through axial chamber 70 and inlet and outlet ports 72 and 116. The seal assembly 104 within cavity 106 is in its inoperative position so that the expansible void chamber 96 is not sealed from the constant volume reservoir chamber 102. Initial downward movement of the mandrel 16 displaces shoulder 107 of abutment 98 into engagement with the seal assembly 104 thereby to seal the void chamber 96. Continued downward travel of the mandrel will accordingly cause development of suction pressure within the expanding void chamber 96, at the same time that pressure increases within the chamber 68, which is being contracted. The hydrostatic fluid pressure of the tool further causes the seal 104 to abut shoulder 107. That is, the hydrostatic fluid pressure biases the seal 104, thereby holding it in its operative sealing position against shoulder 107. As the negative pressure within the expanding void chamber 96 increases, the postively increasing pressure in chambers 68 and 102 is controllably reduced by the restricted outflow of operating fluid from chamber 102 through one-way check valve 136 and the flow metering valve device 128 into the control chamber 137. Because of this restricted outflow of operating fluid from chambers 68 and 102, retarded movement of the mandrel 16 is permitted and at the same time, a net nagative pressure is developed internally within the jarring tool. The pressure of the operating fluid within control chamber 137 is maintained during this phase of operation at the ambient well bore pressure by means of the balancing piston 152 exposed on its lower surface to well-bore pressure by well bore fluid within the sensing chamber 154. It should be appreciated that the axial compressive force applied to the mandrel 16 to initiate its downward travel must be sufficient to maintain continued retarded downward movement of the mandrel until release occurs, at which point downward travel of the mandrel continues at an accelerated rate. Release occurs when the port 74 formed in the hammer mandrel 58 moves into fluid communication with the expanding void chamber 96, thereby equalizing pressures within the expanding void chamber 96 and contracting chamber 68 by means of axial chamber 70. The equalized pressure, which is also established within reservior chamber 102 through axial chamber 70, will be negative relative to the well bore pressure because of the preceding restricted outflow from chamber 102 through the metering valve device 128 as described above.

At the same time that pressures within the chambers 96 and 68 are equalized, the port 156 in the lower end of the mandrel bypasses the seal 166 in the lower seal portion 30, thereby blocking fluid communication between the lower sensing chamber 154 and the well bore. Thus, during accelerated travel of the mandrel downwardly toward the impact position, a negative internal pressure within the jarring tool exists which will cause a restricted in-flow through restrictor 158 into chamber 154. Since flow will be conducted through the helical restrictor one-way check valve 138 from chamber 137 maintained at the same pressure as chamber 154 by the balancing piston 152, internal negative system pressure will accordingly be gradually increased towards the well-bore pressure value. The magnitude of the negative internal system pressure achieved during initial retarded travel of the mandrel is controlled so that it does not increase to the bore pressure value, under control of restrictor 158, until after impact has occurred. FIG. 9 schematically illustrates such condition of the jarring tool in the closed impact position. From this closed position, the mandrel may be displaced upwardly in a return direction as shown by arrow 174 to complete a jarring cycle, and to prepare for a subsequent cycle.

It will be appreciated from the foregoing that downward travel of the mandrel 16 is accelerated after release when the port 72, acting as a position responsive valve, equalizes pressures within the expanding void chamber 96 and the contracting pressure generating chamber 68. Further, by virtue of the restricted inflow of well-bore fluid through restrictor 158, a pressure differential is externally applied to the jarring tool by well bore pressure fluid to augment the axial compressive force intially applied, thereby to increase the downward acceleration of the mandrel to the impact position.

Figure 10:
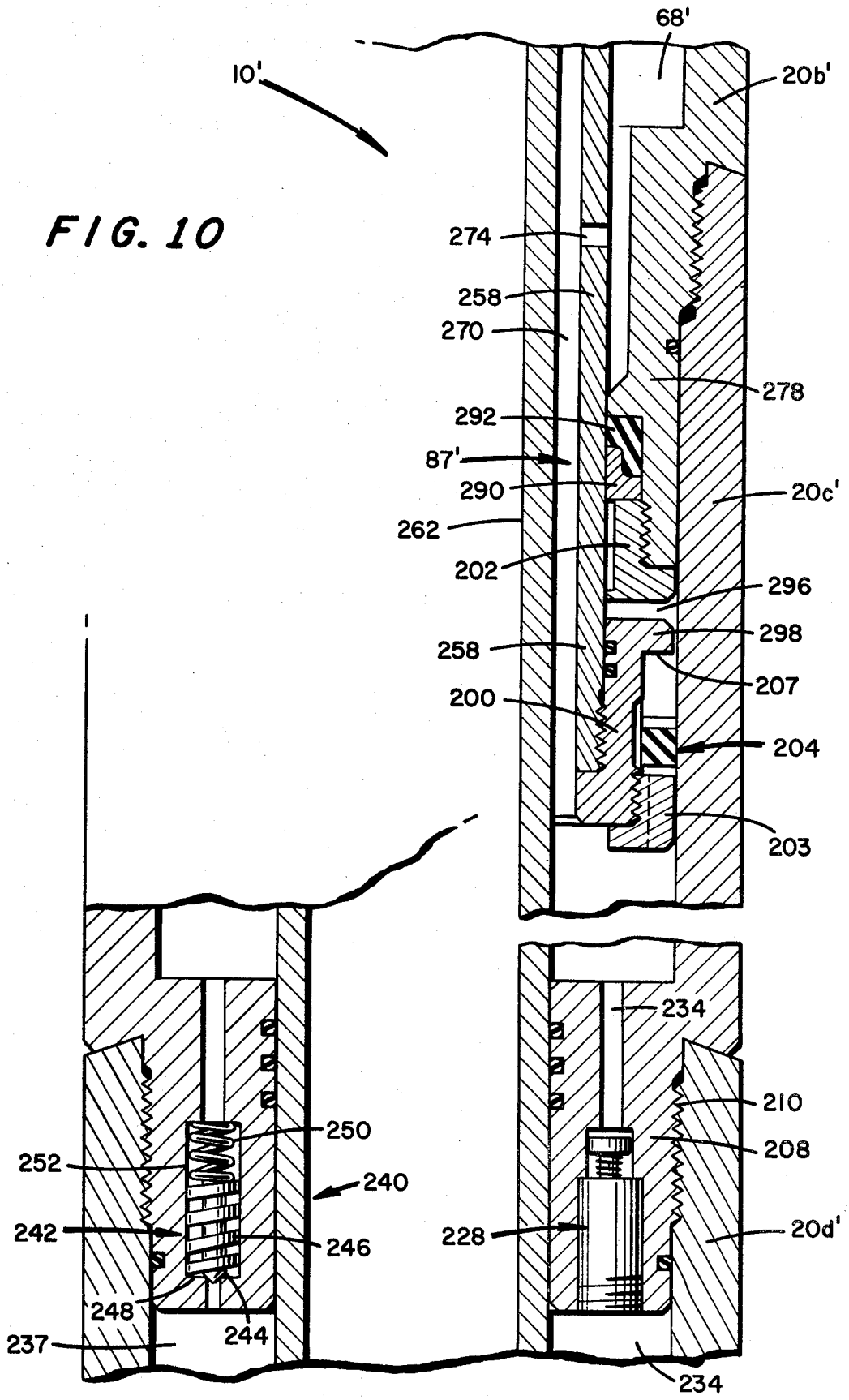
FIG. 10 is a partial side sectional view showing a modification of the jarring tool structure shown in FIGS. 3 and 5.
Figure 11:
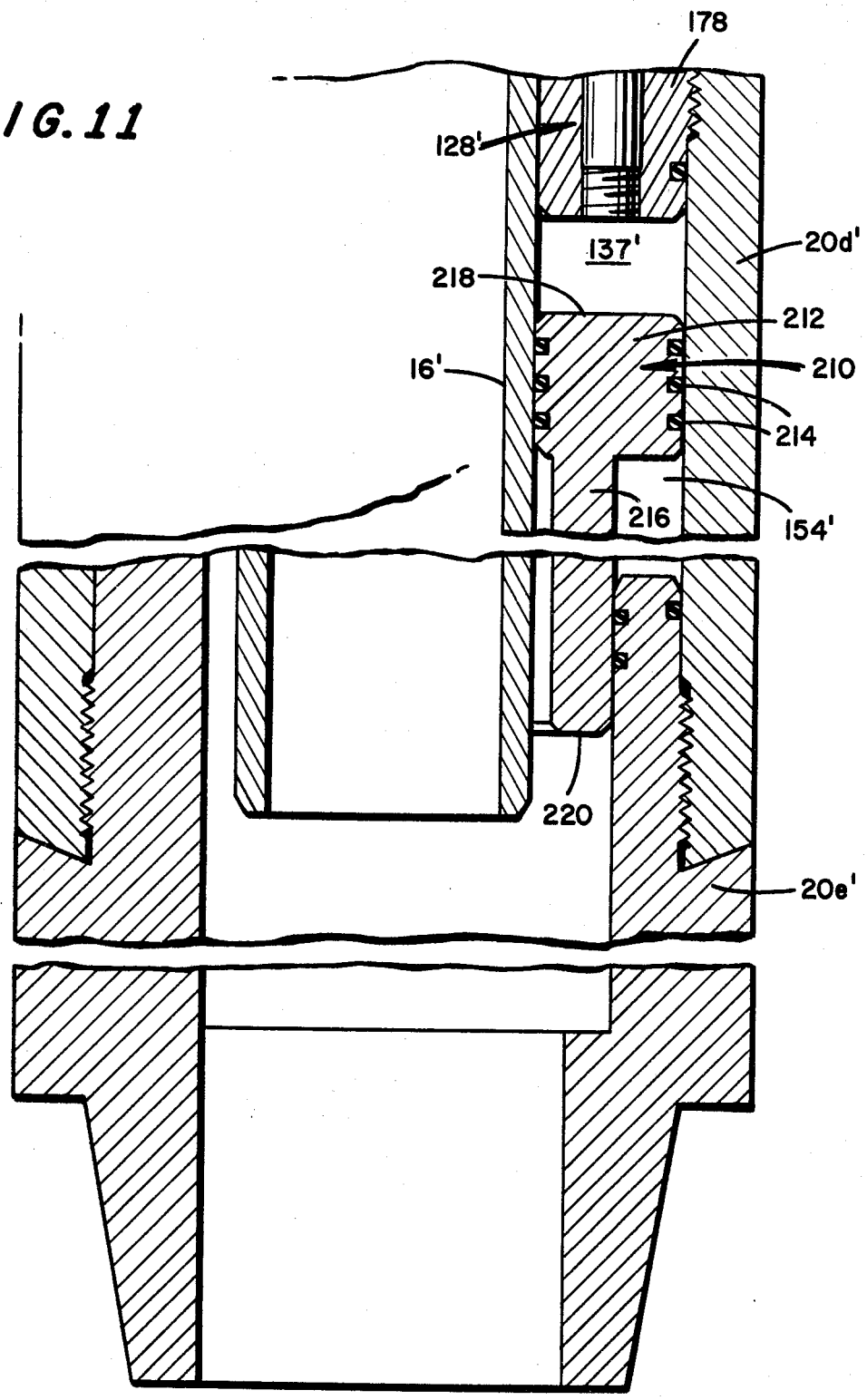
FIG. 11 is a partial sectional view of a modified jarring tool corresponding to the jarring tool shown in FIG. 10 and constituting a variation of the structure shown in FIG. 7.

As mentioned hereinabove, although only two slidable seal assemblies 104 and 104' and associated expansible void chambers 96 and 96' are shown in FIGS. 1–7, it will be appreciated that any number of such expanding void chambers and shiftable seal devices may be utilized in order to obtain the desired tripping force and acceleration characteristics for the jarring tool 10. The structure of the jarring tool 10' shown in FIGS. 10 and 11 is similar to that of jarring tool 10, shown in FIG. 3, except that a single unitary cylindrical mandrel member 258 is connected to inside mandrel 262 and radially spaced therefrom to form the axial chamber 270 which communicates at its lower end with the reservoir chamber 202. An adapter element 200, which is very similar to the threaded adapter 118 of FIG. 6, is threadably secured to the lower end of the mandrel 258 and is provided with a radially enlarged abutment portion 298 at its upper end and having a shoulder 207 against which the moveable seal 204 abuts when in its operative position of sealing the expansible void chamber 296. The void chamber 296 is sealed at its upper axial end by the wiping seal element 292 carried on a rigid sleeve 290 and held assembled in extension 278 of the housing section **20*b'*, which is threadably coupled to the housing section 20*c'*. A threaded assembly collar 203 is connected to the lower end of extension 278 in order to hold the seal assembly 287 in wiping contact with the mandrel 258 to not only seal the expansible void chamber 296 but also the pressure generating chamber 268 located thereabove. The mandrel 258 is also provided with a position responsive valving passage 274, which functions in a manner hereinbefore described with respect to port 74 of jarring tool 10, to equalize pressures within chambers 268 and 270 to release the mandrel for accelerated travel following its initial retarded movement. The foregoing structure of the jarring tool 10' is preferable for a single expansible void chamber and displaceable seal arrangement, as compared to the structure associated with jarring tool 10**, which may accommodate any number of void chambers and associated displaceable seal devices.

A flow metering valve 228 through which restricted outflow from the reservoir chamber 202 occurs during the initial retarded travel stage of operation, is carried by the housing section **20*c'* shown in FIG. 10, as compared to the mounting of the metering valve 128 on the mandrel in the jarring tool 10 of FIGS. 1–9. Thus, the lower end of the housing section 20*c'*, as shown in FIG. 10, is formed as a valve body 208, to which the housing section 20*d'* is threadably connected at 210. The flow metering valve device 228 is mounted within the valve body 208 and is in communication with the reservoir chamber 202 through inlet passage 234. Restricted outflow is accordingly conducted from reservoir chamber 202 into a control chamber 237**.

Mounted within the lower section of housing section, 20C is a one-way check valve assembly 240 which establishes fluid communication between chambers 237 and 202 when the pressure in chamber 202 drops below the pressure in chamber 237. The one-way check valve assembly 240 is mounted in 180° relationship to the flow metering device 228. The one-way check valve assembly 240 includes a valve element 242, which is formed having a tapered tip portion 244 and a shank portion 246. The shank portion 246 is formed as a helical restrictor, as used in meter valve 128 of FIG. 6 and as described in my above-identified copending application. The restrictor portion 246 provides a time delay in equalizing pressures. The valve 240 is biased to a closed position on a valve seat 248 by a spring 250 enclosed within a valve cavity 252. An inlet passage 254 establishes fluid communication between chamber 202 and the valve cavity 252, while fluid communication is provided by outlet passage 256 in the lower portion of housing section **20*c'***.

Referring to FIG. 11, the control chamber 237' formed between the housing section **20*d'* and mandrel 262 is isolated from the well-bore sensing chamber 154' by a pressure reducing type of balancing piston 211, which is functionally similar to the balancing piston 152 of FIGS. 1–9. The balancing piston 211 includes an enlarged upper portion 212 having seals 214 in wiping contact with the confronting cylinder walls of the housing section and mandrel. The pressure reducing balancing piston 210 includes a long, narrow, lower, extension portion 216 that extends into the lowermost housing section 20*e'* which is threadably connected to housing section 20*d'*. The fluid pressure surface 218 at the top of the balancing piston 210 is designed to be larger than the fluid pressure surface 220 at the bottom of the extension portion. In view of the area differential between the two fluid pressure surfaces 218 and 220, presented at the upper and lower ends of the balancing piston 212, the pressure within the control chamber 237 will be a function of the static well-bore pressure and the pressure in sensing chamber 154'. Operation of the balancing piston 212 is otherwise the same as the balancing piston 152 associated with jarring tool 10, as discussed relative to FIGS. 1–9**.

Figure 14:
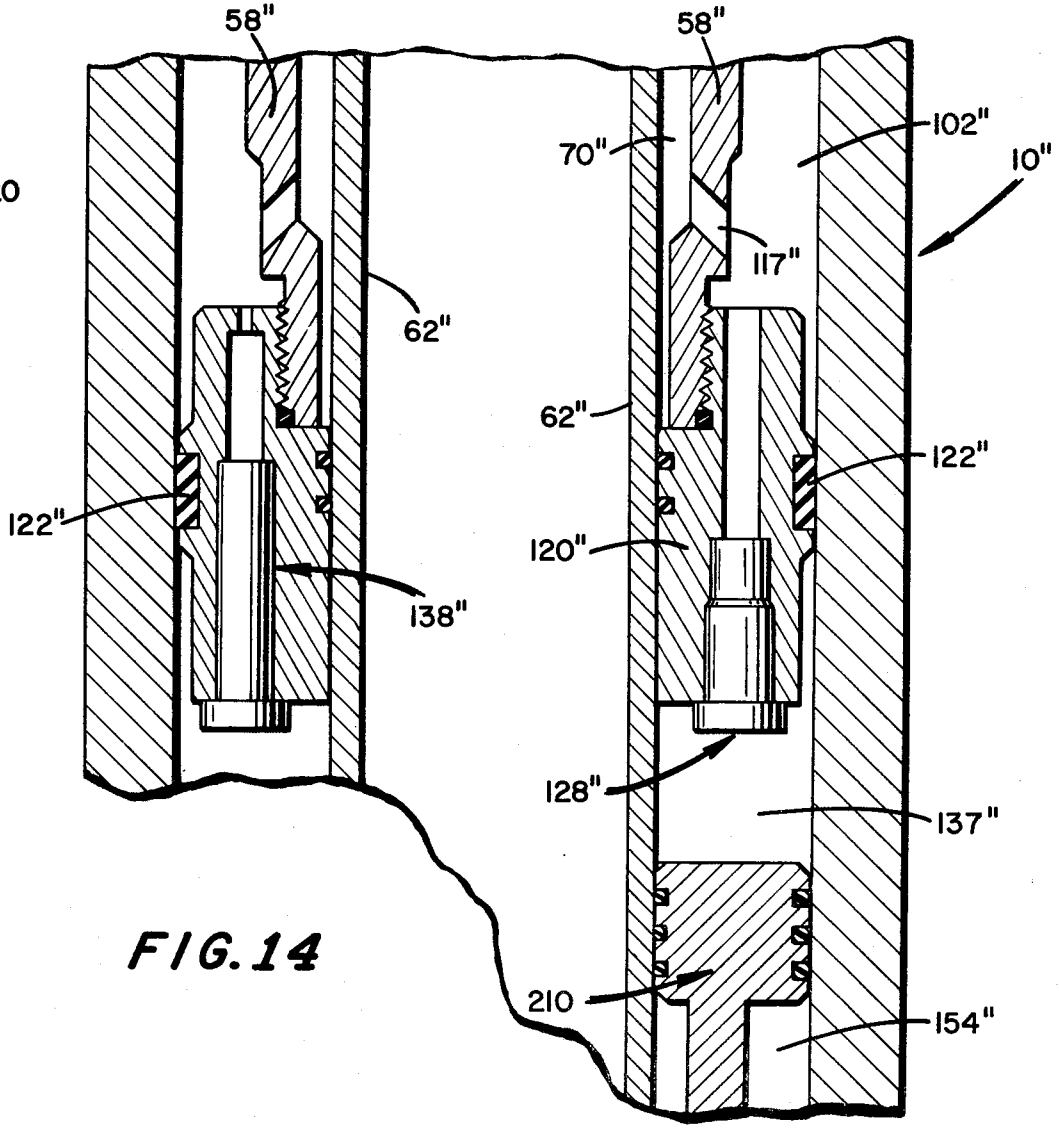
FIG. 14 is a partial side section view of a jarring tool corresponding to the jarring tool shown in FIGS. 12 and 13, and constituting a second variation of the structure shown in FIG. 6.
Figure 12:
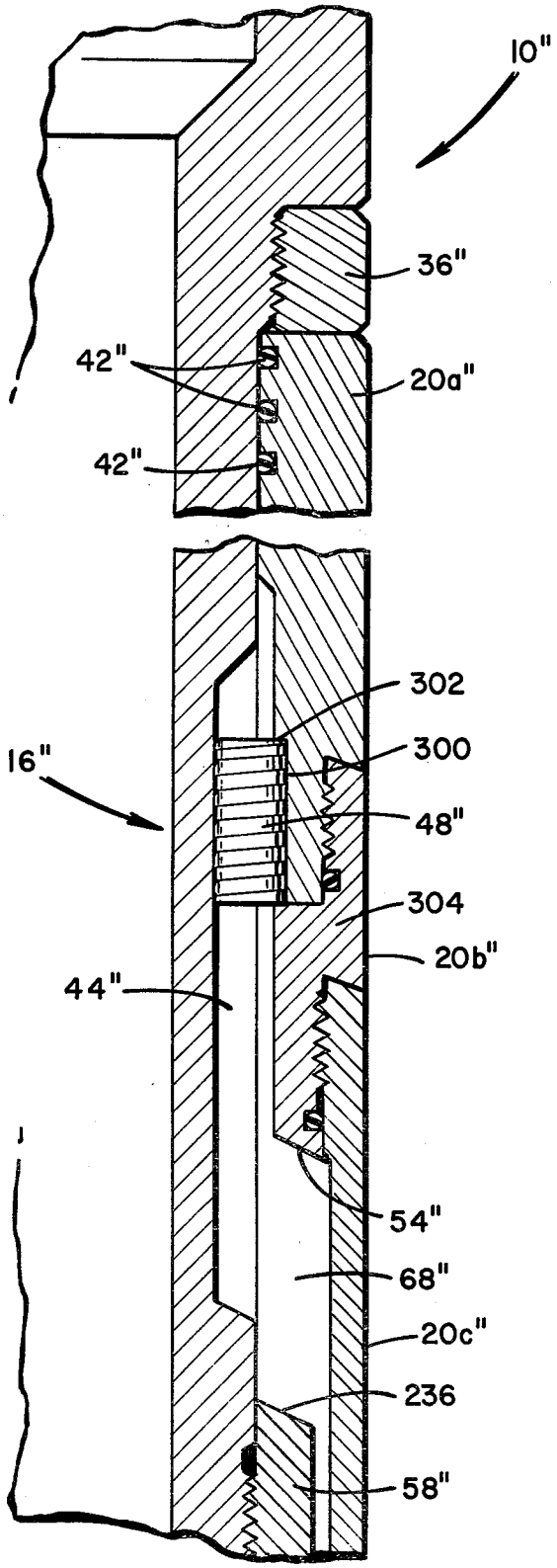
FIG. 12 is a partial side sectional view illustrating yet another embodiment of the jarring tool constituting a second variation of the structure shown in FIG. 3.
Figure 13:
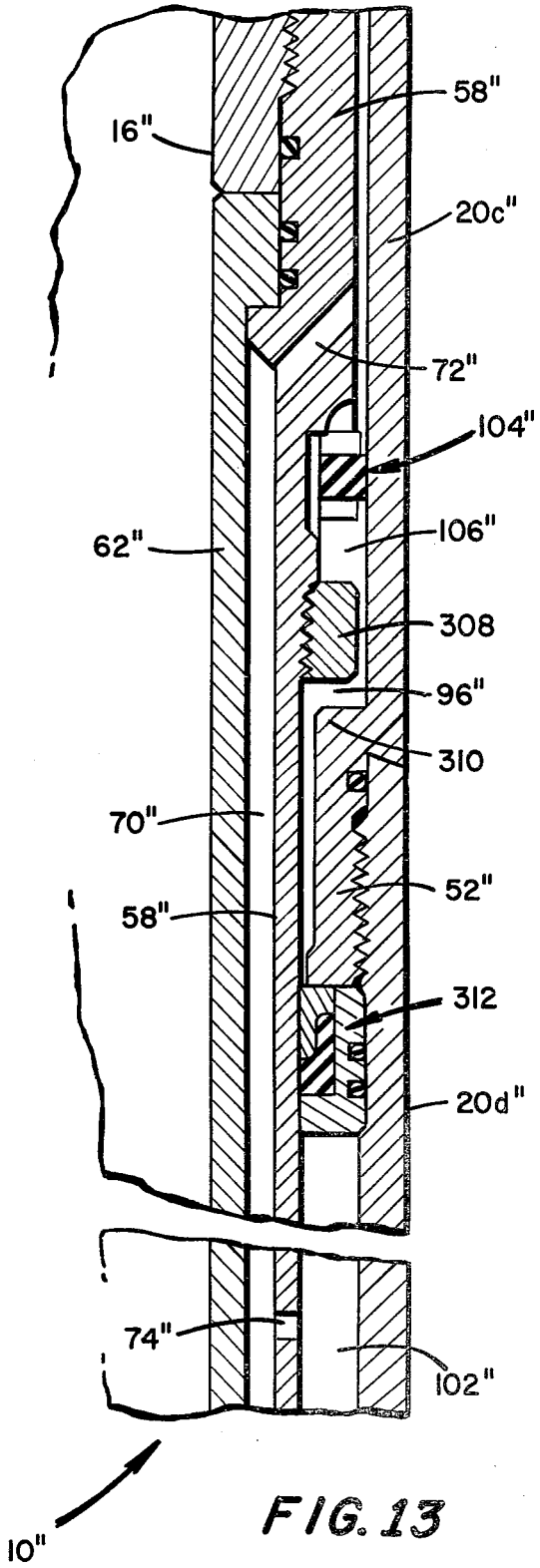
FIG. 13 is a partial side sectional view of a jarring tool corresponding to the embodiment shown in FIG. 12 and constituting a second variation of the structure shown in FIG. 5.

The jarring tools 10 and 10' hereinabove described, operate similarly to deliver an impact blow upon downward travel of the inner mandrel during a jarring cycle. FIGS. 12–14 illustrate another embodiment of the present invention in the form of a jarring tool 10'', for delivering an upward blow to a lodged item and moreover for accelerating the mandrel in an upward direction to increase the intensity of the blow. Thus, in its initial position at the beginning of a jarring cycle, the mandrel 16'' associated with the jarring tool 10'', as shown in FIG. 12, is in contact with a wear ring 36'' mounted at the upper end of the seal portion **20*a''*. Located within the upper housing section 20*a''* are the upper seals 42'' which are arranged in wiping contact with the outer surface of mandrel 16''. As in the case of the jarring tool 10, the upper housing section carries torque transmitting key elements 48'', slidingly received in spline grooves 44'' formed in the mandrel 16''. The keys 48'' are located in pockets 300 in the case 20*a''* and are held in place by shoulder 302 and the threaded adapter 304, which joins outer casings 20*a''* and 20*b''*. The keys 48'' operate to lock the mandrel 16'' to the case 20*a''* so as to permit torque transfer yet allow telescopic movement between mandrel 16'' and case 20*a''*. The threaded adapter 304 is provided with a lower bevelled abutment surface 54''**, axially spaced from the confronting bevel surface 236 at the upper end of a hammer mandrel 58", which is threadably coupled to mandrel 16". The chamber 68" is formed between the abutment 54" and the mandrel element 58" and is in fluid communication through a port 72" with the axial chamber 70" formed between inside mandrel 62" and the cylindrical extension of the hammer mandrel 58", threadably connected to mandrel 16" as shown in FIG. 13. A cavity 106" is formed between the hammer mandrel 58" and the housing section 20c" within which the seal assembly 104" is displaceable from the inoperative position shown in FIG. 13 to an operative position, abutting the retaining collar 308', which is threadably connected to the hammer mandrel 58". The expansible void chamber 96" adapted to be sealed by the slidable seal assembly 104" is formed between the retaining collar 308 and the shoulder portion 310 of the lower coupling portion 52" of housing section 20c". A seal assembly 312, clamped by the lower edge of housing portion 20c" and a shoulder in housing portion 20d" is in wiping contact with the outer cylindrical surface of hammer mandrel 58" to seal the void chamber 96" at its axial lower end. The seal assembly 312 also seals the upper axial end of the reservior chamber 102", which is in fluid communication with axial chamber 70" through port 74".

The lower end of the axial passage 70" is shown in FIG. 14 and communicates with the reservoir chamber 102" through the lower port 117" formed in the mandrel 58". The mandrel 58" is threadably connected at its lower end to an adapter housing 120" within which is mounted the flow metering valve 128", for continuing a restricted outflow from the reservior chamber 102" into a control chamber 137", as in the case of the metering flow valve 128 in jarring tool 10. Similarly, a one-way check valve 138" is also carried in the adapter housing 120" to establish restricted fluid communication in the other direction between the control chamber 137" and the reservoir chamber 102" during accelerated travel of the mandrel in an upward direction. The control chamber 137" is isolated from a sensing chamber 154" as shown in FIG. 14 by a pressure reducing type of balancing piston 210, operating in a fashion similar to that described with respect to jarring tool 10'. Except for the direction of travel initiated by an axial tensional force applied to the mandrel 16" at the well bore surface, the jarring tool 10" operates in a fashion identical to that of jarring tool 10'. That is, an impact jarring blow will deliver at an accelerated rate, i.e., at a higher momentum level, than that produced by the amount of force applied at the well head.

It will be seen from the above discussion that the volumes of the void chambers displace, prior to equalization of internal pressures, must be greater than the volumes of the contracting chambers during free travel of the mandrel to achieve mandrel acceleration.

As a further discussion of the operation of the inventive jarring device for delivering an upwardly accelerated jarring glow, reference is made to FIGS. 12–14. The raising of the mandrel will operably position the sealing surfaces of the mandrel under the slidable seals that are located near the top portion of the mandrel. The raising of the mandrel and the attendant closing of the fluid passage by the seals, will cause a void chamber to be formed below the seals. The fluid pressure generated within the system by the contraction of the variable volume pressure chamber will have to be overcome, in order to further raise the mandrel. Once sufficient force is applied, the expanding void chambers cause fluid to be displaced through the meter into the chamber above the reducing balancing piston. In the event that the tension applied is greater than the holding force of the void chambers, then fluid being restricted from flowing out of the upper system by the fluid meter will increase in pressure. Additionally, as the mandrel is raised, a volume of fluid that is in the upper system between the top seals of the case to the upper mandrel and a seal that is on the lower mandrel housing that contain the meter and sealingly engages the case, has to be transferred through the meter. The tension load is generating pressure in the upper system which in turn acts on the two void chambers plus the area of the difference between the mandrel outside diameter and that of the seal to the case.

It is understood, of course, that the foregoing detailed description is given by way of example only and is not intended to limit the present invention, except as set forth in the appended claims.

What is claimed is:

1. In combination with a jarring device having a pair of axially elongated members displaceable relative to each other toward an impact position within a well bore under a predetermined axial force applied to one of said members, apparatus for controlling movement of said members relative to each other comprising: fluid retarding means for opposing said axial force in response to initial movement of said one of the members toward the impact position, means rendered operative by the fluid retarding means for generating a suction pressure during said initial movement, wherein said means for generating a suction pressure includes an expansible void chamber formed between said members, shiftable seal means displaceable by said one of the members, in response to said initial movement, to an operative position sealing the void chamber, and means responsive to pressure generated by the fluid retarding means while opposing said tensioning force for holding the seal means in said operative position, release means interconnecting the fluid retarding and means for generating a suction pressure following said initial movement for disabling the fluid retarding means to permit acceleration of said one of the members by the axial force to the impact position, and means responsive to said disabling of the fluid retarding means for increasing said acceleration of said one of the members as a function of the suction pressure generated, wherein said release means includes position responsive valve means for conducting flow of fluid between the fluid retarding means and the void chamber in by-pass relation to the seal means to equalize pressures at a predetermined negative pressure below static well bore pressure.

2. The combination of claim 1 wherein said one of the members travels downwardly toward the impact position during a jarring cycle.

3. The combination of claim 1 wherein said one of the members travels upwardly toward the impact position during a jarring cycle.

4. The combination of claim 1 wherein said acceleration increasing means includes a source of fluid under a static pressure proportional to well bore pressure, flow control means connected to said source for conducting restricted flow of fluid thereto from the well bore, and means for preventing said restricted flow of fluid until the fluid retarding means is disabled.

5. The combination of claim 4 wherein said source of static fluid pressure includes a cavity formed between the members, a balancing piston displaceable within the cavity forming a fluid control chamber isolated form the well bore and a sensing pressure chamber in communication with the well bore, said fluid control chamber being in fluid communication with the fluid retarding means through the flow control means.

6. The combination of claim 5 wherein said flow control means includes one-way valve means for conducting operating fluid in one direction from the fluid control chamber to the fluid retarding means, flow metering means for conducting said operating fluid in the other direction at a restricted flow rate from the fluid retarding means to the fluid control chamber, means for blocking fluid communication between the sensing pressure chamber and the well bore following said initial movement of said one of the members, and flow restrictor means for conducting restricted flow to the sensing pressure chamber from the well bore during accelerating movement of said one of the members to the impact position.

7. The combination of claim 1 wherein said acceleration increasing means includes a source of fluid under a static pressure proportional to well bore pressure, flow control means connected to said source for conducting restricted flow of fluid thereto from the well bore, and means for preventing said restricted flow of fluid until the fluid retarding means is disabled.

8. The combination of claim 7 wherein said source of static fluid pressure includes a cavity formed between the members, a balancing piston displaceable within the cavity forming a fluid control chamber isolated from the well bore and a sensing pressure chamber in communication with the well bore, said fluid control chamber being in fluid communication with the fluid retarding means through the flow control means.

9. The combination of claim 8 wherein said flow control means includes one-way valve means for conducting operating fluid in one direction from the fluid control chamber to the fluid retarding means, flow metering means for conducting said operating fluid in the other direction at a restricted flow rate from the fluid retarding means to the fluid control chamber, means for blocking fluid communication between the sensing pressure chamber and the well bore following said initial movement of said one of the members, and flow restrictor means for conducting restricted flow to the sensing pressure chamber from the well bore during accelerating movement of said one of the members to the impact position.

10. In combination with a jarring tool having a pair of axially elongated members displaceable relative to each other toward an impact position within a well bore under a predetermined axial accelerating force, variable volume chamber means for retarding movement and generating a suction pressure during initial travel of one of the members toward the impact position, wherein said variable volume chamber means includes a pair of pressure chambers respectively contracted and expanded during said initial travel of said one of the members, seal means biased to an operative position by pressure generated in the contracting chamber for sealing the expanding chamber to enable development of said suction pressure therein, reservoir means charged with an operating fluid supplied to the chambers, and flow control means connected to the reservoir means for restrictively reducing the increase in pressure of the operating fluid within the contracting chamber, and means releasing said one of the members for accelerated travel under said accelerating force and following said initial travel, means responsive to the suction pressure generated for increasing the acceleration imposed on said one of the members by the predetermined axial accelerating force.

11. The combination of claim 10 wherein said releasing means includes passage means interconnected between the reservoir means and the chambers for equalizing the pressure of the operating fluid within said chambers at a value below static well bore pressure.

12. The combination of claim 11 wherein said suction pressure responsive means includes a pressure control chamber to which the flow control means is connected for restrictively reducing the pressure generated in the contracting chamber, means for maintaining the operating static fluid in said pressure control chamber at a pressure proportional to well bore pressure only during said initial travel of said one of the members, one-way valve means connecting said reservoir means to the pressure control chamber for reducing the static pressure therein as a function of the equalized pressure in the reservoir means, and means operative during said accelerated travel of said one of the members for establishing a restrictively inflow of fluid from the well bore to controllably increase the reduced static pressure.

13. The combination of claim 12 wherein said restrictive inflow means includes a well bore pressure sensing chamber in fluid communication with the well bore during said initial travel, means for blocking said fluid communication during accelerated travel, restrictor means for conducting a restricted inflow of fluid from the well bore to the sensing chamber during accelerated travel, and balancing piston means for transferring instantaneous pressure in the sensing chamber to the operative fluid in the pressure control chamber.

14. Apparatus for use with a jarring device of the type having at least two elongated members axially displaceable with respect to one another toward an impact position within a well bore, upon application of an axial force to one of said members, said apparatus comprising: fluid operated means arranged to oppose said axial force and to retard said displacement of said members in one direction upon initial movement of one of said members toward said impact position, negative pressure generating means responsive to said fluid operated means for generating a negative pressure during said initial movement of said members, wherein said negative pressure generating means includes at least one expansible void chamber formed between the ends of said at least two axially displaceable elongated members, slidable seal means movable from a first position by one of said members in response to said initial movement to a second position whereby at least one expansible void chamber is sealed, and means for holding said seal means in said second position in response to the operation of said axial force by said fluid operated means, disabling means arranged to interconnect said fluid operated means and said negative pressure generating means for disabling said fluid operated means after said initial movement, thereby to cause said axial force to accelerate one of said members to said impact position, wherein said disabling means includes valve means for permitting fluid flow between said fluid operated means and said void chamber in by-pass relation to the seal means, thereby to equalize pressures at a predetermined negative pressure below static well bore pressure, and fluid pressure amplifying means responsive to actuation of said disabling means for increasing the acceleration of said one of said members by an amount related to the negative pressure generated by said negative pressure generating means.

15. The apparatus of claim 14 wherein said fluid pressure amplifying means includes: a source of fluid under static pressure related to well bore pressure, selectably operable flow control means connected to said source for restricting fluid flow thereto from the well bore, and means responsive to said fluid operated means for operating said flow control means when said fluid operated means is not enabled by movement of one of said members.

16. The apparatus of claim 15 wherein said source of fluid includes a pressure sensing chamber in communication with the well bore, and a fluid control chamber formed between said members being isolated from the well bore and being in fluid communication with the fluid retarding means through said flow control means.

17. Apparatus for use in a jarring device having a pair of axially elongated members displaceable relative to each other toward an impact position within a well bore under a predetermined axial force applied to one of said members, said apparatus for controlling movement of said members relative to each other, comprising: fluid retarding means for opposing said axial force in response to initial movement of said one of the members toward the impact position, negative pressure generating means rendered operative by the fluid retarding means during said initial movement having an expansible void chamber formed between said members and shiftable seal means displaceable by said one of the members to an operative position sealing the void chamber in response to said initial movement, release means interconnecting the fluid retarding and suction pressure generating means following said initial movement for disabling the fluid retarding means to permit acceleration of said one of the members by the axial force to the impact position, and means responsive to said disabling of the fluid retarding means for increasing said acceleration of said one of the members as a function of the suction pressure generated having a source of fluid under a static pressure proportional to well bore pressure, flow control means connected to said source for conducting restricted flow of fluid thereto from the well bore, and means for preventing said restricted flow of fluid until the fluid retarding means is disabled.

18. The combination of claim 17 wherein said one of the members travels downwardly toward the impact position during a jarring cycle.

19. The combination of claim 17 wherein said one of the members travels upwardly toward the impact position during a jarring cycle.

20. The combination of claim 17 wherein said source of static fluid pressure includes a cavity formed between the members, a balancing piston displaceable within the cavity forming a fluid control chamber isolated from the well bore and a sensing pressure chamber in communication with the well bore, said fluid control chamber being in fluid communication with the fluid retarding means through the flow control means.

21. The combination of claim 20 wherein said flow control means includes one-way valve means for conducting operating fluid in one direction from the fluid control chamber to the fluid retarding means, flow metering means for conducting said operating fluid in the other direction at a restricted flow rate from the fluid retarding means to the fluid control chamber, means for blocking fluid communication between the sensing pressure chamber and the well bore following said initial movement of said one of the members, and flow restrictor means for conducting restricted flow to the sensing pressure chamber from the well bore during accelerating movement of said one of the members to the impact position.

* * * * *